US007225865B2

(12) United States Patent
Akerlund

(10) Patent No.: US 7,225,865 B2
(45) Date of Patent: Jun. 5, 2007

(54) APPARATUS FOR POSITIONING A TONG AND DRILLING RIG PROVIDED WITH SUCH AN APPARATUS

(75) Inventor: Tor Jan Akerlund, Forus (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/044,639

(22) Filed: Jan. 10, 2002

(65) Prior Publication Data

US 2002/0056573 A1 May 16, 2002

Related U.S. Application Data

(63) Continuation of application No. 09/355,439, filed as application No. PCT/GB97/03174 on Nov. 19, 1997, now Pat. No. 6,412,553.

(30) Foreign Application Priority Data

Jan. 29, 1997 (GB) ..... 9701790.9

(51) Int. Cl.
*E21B 19/18* (2006.01)

(52) U.S. Cl. ..... 166/77.51; 166/85.1; 175/85

(58) Field of Classification Search ..... 175/52, 175/85; 166/77.51, 77.52, 77.53, 85.1; 81/57.35

See application file for complete search history.

(56) References Cited

U.S. PATENT DOCUMENTS 2,615,681 A * 10/1952 True ..... 166/77.51
2,668,689 A 2/1954 Cormany ..... 255/35
2,692,059 A 10/1954 Bolling, Jr. ..... 214/2.5
3,253,336 A 5/1966 Brown
3,392,609 A 7/1968 Bartos ..... 81/57
3,505,913 A * 4/1970 Dickmann et al. ..... 81/57.35
3,518,903 A 7/1970 Ham et al. ..... 81/57.16
3,561,526 A 2/1971 Williams et al.
3,603,387 A 9/1971 Schoeffler
3,766,979 A 10/1973 Petrick
3,838,613 A 10/1974 Wilms ..... 81/57.34
3,839,791 A 10/1974 Feamster, III
3,840,128 A 10/1974 Swoboda, Jr. et al. ... 214/1 BD
3,863,667 A 2/1975 Ward
3,881,375 A * 5/1975 Kelly ..... 81/57.35
3,885,679 A 5/1975 Swoboda, Jr. et al. ... 214/1 BD
3,978,990 A * 9/1976 Honea ..... 212/167

(Continued)

FOREIGN PATENT DOCUMENTS

EP 0 778 392 6/1997

(Continued)

*Primary Examiner*—Jennifer H Gay
(74) *Attorney, Agent, or Firm*—Patterson & Sheridan, L.L.P.

(57) ABSTRACT

A method and apparatus for positioning a tong comprises a piston and cylinder assembly and a mounting assembly therefor. The mounting assembly is mounted on a support beam in the drilling derrick and the piston and cylinder assembly is pivotally mounted on the mounting assembly. The piston and cylinder assembly can be pivoted between an operative position in which it can be extended and retracted to move a tong towards and away from a string of tubulars, and an inoperative position in which the piston and cylinder assembly extends along an upwardly extending axis with part of the piston and cylinder assembly disposed to either side of the mounting assembly.

52 Claims, 3 Drawing Sheets

U.S. PATENT DOCUMENTS

| | | | | | |
|---|---|---|---|---|---|
| 3,980,143 | A | | 9/1976 | Swartz et al. | 173/100 |
| 4,077,525 | A | | 3/1978 | Callegari et al. | 214/2.5 |
| 4,181,196 | A | | 1/1980 | Darby et al. | |
| 4,194,383 | A | | 3/1980 | Huzyak | 72/245 |
| 4,227,197 | A | | 10/1980 | Nimmo et al. | |
| 4,229,121 | A | | 10/1980 | Brown | |
| 4,274,777 | A | | 6/1981 | Scaggs | 414/22 |
| 4,277,197 | A | | 7/1981 | Bingham | 403/104 |
| 4,440,220 | A | | 4/1984 | McArthur | 166/85 |
| 4,492,136 | A | | 1/1985 | Walker | |
| 4,493,150 | A | | 1/1985 | Garcia et al. | |
| 4,506,480 | A | * | 3/1985 | Murrill et al. | 52/121 |
| 4,557,628 | A | | 12/1985 | Cowan | |
| 4,604,724 | A | | 8/1986 | Shaginian et al. | 364/478 |
| 4,652,195 | A | * | 3/1987 | McArthur | 414/22.51 |
| 4,681,158 | A | | 7/1987 | Pennison | 166/77.5 |
| 4,686,873 | A | | 8/1987 | Lang et al. | 81/57.35 |
| 4,691,587 | A | | 9/1987 | Farrand et al. | 74/493 |
| 4,725,179 | A | | 2/1988 | Woolslayer et al. | 414/22 |
| 4,832,552 | A | | 5/1989 | Skelly | 414/22.54 |
| 4,843,945 | A | | 7/1989 | Dinsdale | 81/57.34 |
| 4,921,386 | A | | 5/1990 | McArthur | 414/22.51 |
| 5,049,020 | A | | 9/1991 | McArthur | 414/22.51 |
| 5,060,542 | A | | 10/1991 | Hauk | 81/57.34 |
| 5,062,756 | A | * | 11/1991 | McArthur et al. | 414/22.51 |
| 5,112,184 | A | * | 5/1992 | Tapper et al. | 414/728 |
| 5,176,518 | A | | 1/1993 | Hordijk et al. | 434/37 |
| 5,263,660 | A | * | 11/1993 | Brozik | 254/269 |
| 5,294,228 | A | | 3/1994 | Willis et al. | 414/22.55 |
| 5,354,150 | A | | 10/1994 | Canales | 405/154 |
| 5,368,113 | A | * | 11/1994 | Schulze-Beckinghausen | 175/162 |
| 5,386,746 | A | | 2/1995 | Hauk | 81/57.34 |
| 5,505,565 | A | * | 4/1996 | Canales | 405/303 |
| 5,509,440 | A | | 4/1996 | Cantaloube et al. | |
| 5,623,994 | A | | 4/1997 | Robinson | |
| 5,661,888 | A | | 9/1997 | Hanslik | 29/407.02 |
| 5,667,026 | A | | 9/1997 | Lorenz et al. | 175/162 |
| 5,711,382 | A | | 1/1998 | Hansen et al. | 175/52 |
| 5,829,605 | A | * | 11/1998 | Poitras | 212/180 |
| 5,907,664 | A | | 5/1999 | Wang et al. | 395/86 |
| 5,931,231 | A | | 8/1999 | Mock | 166/377 |
| 6,125,928 | A | | 10/2000 | Ninivaara et al. | |
| 6,131,597 | A | | 10/2000 | Mendicino et al. | |
| 6,212,976 | B1 | * | 4/2001 | Stogner | 81/57.34 |
| 6,408,944 | B1 | | 6/2002 | Niinivaara et al. | |
| 6,412,553 | B1 | * | 7/2002 | Akerlund | 166/77.51 |
| 6,715,569 | B1 | * | 4/2004 | Rogers | 175/85 |
| 2002/0035897 | A1 | * | 3/2002 | Buytaert et al. | 81/57.35 |

FOREIGN PATENT DOCUMENTS

| | | |
|---|---|---|
| FR | 2 053 088 | 10/1973 |
| GB | 1 469 661 | 7/1974 |
| GB | 2 201 912 | 9/1988 |
| GB | 2 285 077 | 6/1995 |
| GB | 2 313 859 | 12/1997 |
| WO | WO 90/06418 | 6/1990 |
| WO | WO 92/18743 | 10/1992 |
| WO | WO 95/10686 | 4/1995 |
| WO | WO 99/11902 | 3/1999 |

* cited by examiner

APPARATUS FOR POSITIONING A TONG AND DRILLING RIG PROVIDED WITH SUCH AN APPARATUS

CROSS-REFERENCE TO RELATED APPLICATIONS

This application is a continuation of U.S. patent application Ser. No. 09/355,439, filed Nov. 29, 1999, now U.S. Pat. No. 6,412,553, which was the National Stage of International Application No. PCT/GB97/03174, filed Nov. 19, 1997 and published under PCT Article 21(2) in English, and claims priority of United Kingdom Application No. 9701790.9 filed on Jan. 29, 1997. Each of the aforementioned related patent applications is herein incorporated by reference.

BACKGROUND OF THE INVENTION

1. Field of the Invention

The present invention generally relates to an apparatus for positioning a tong and a drilling rig provided with said apparatus.

2. Description of the Related Art

In our PCT Publication No. WO 95/10686 we have described an apparatus for positioning a tong which comprises two rigid members which are each formed by connecting two chains each of which is independently flexible. Whilst this apparatus functions extremely well, it is expensive to manufacture and to maintain.

SUMMARY OF THE INVENTION

In FIG. 4 of the Patent Application, we suggested the use of hydraulic piston and cylinder assemblies as an alternative to the chains. This has not been adopted commercially as the hydraulic pistons and cylinders and associated tong could not readily be moved out of the way to facilitate other operations on the rig floor.

With a view to reducing this problem, the present invention provides an apparatus for positioning a tong, which apparatus comprises a piston and cylinder assembly, and a mounting assembly therefor, characterised in that said piston and cylinder assembly can be pivoted between an operative position in which it can be extended and retracted to move a tong towards and away from a string of tubulars, and an inoperative position in which said piston and cylinder assembly extends along an upwardly extending axis with part of said piston and cylinder assembly disposed to either side of said mounting assembly.

Typically, in use, said mounting assembly will be mounted on a support beam which is from 2 to 3 m above the rig floor.

Preferably, said piston and cylinder assembly comprises a piston and cylinder mounted within a telescopically extensible structure.

Advantageously, said piston and cylinder has two stages and said telescopically extensible barrel comprises an outer barrel, an intermediate structure and an inner barrel.

Preferably, said mounting assembly comprises a bearer which can be clamped to a structural member in a drilling tower, a carriage pivotally mounted on said bearer and a clamp assembly for securing said piston and cylinder assembly to said mounting assembly.

Advantageously, said apparatus includes a motor, for example, a hydraulic motor, actuable to adjust the position of said piston and cylinder assembly with respect to said mounting assembly.

The present invention also provides a drilling floor, a support beam adjacent said drilling floor, the mounting assembly of an apparatus in accordance with the present invention mounted on said support beam, the piston and cylinder assembly of an apparatus in accordance with the present invention mounted on said mounting assembly and a tong attached to the free end of said piston and cylinder assembly.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
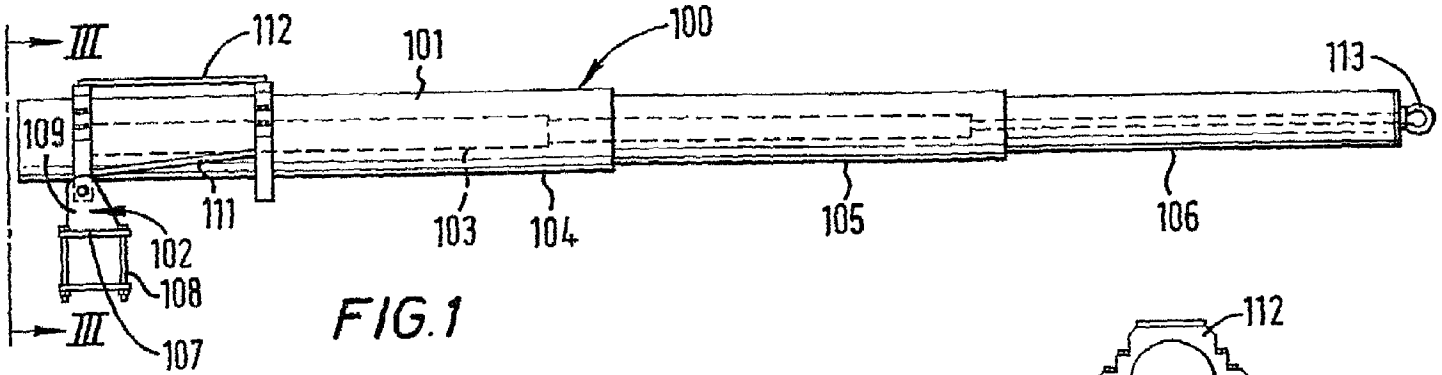
Figure 3:
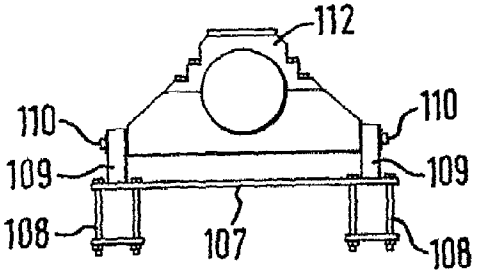
Figure 2:
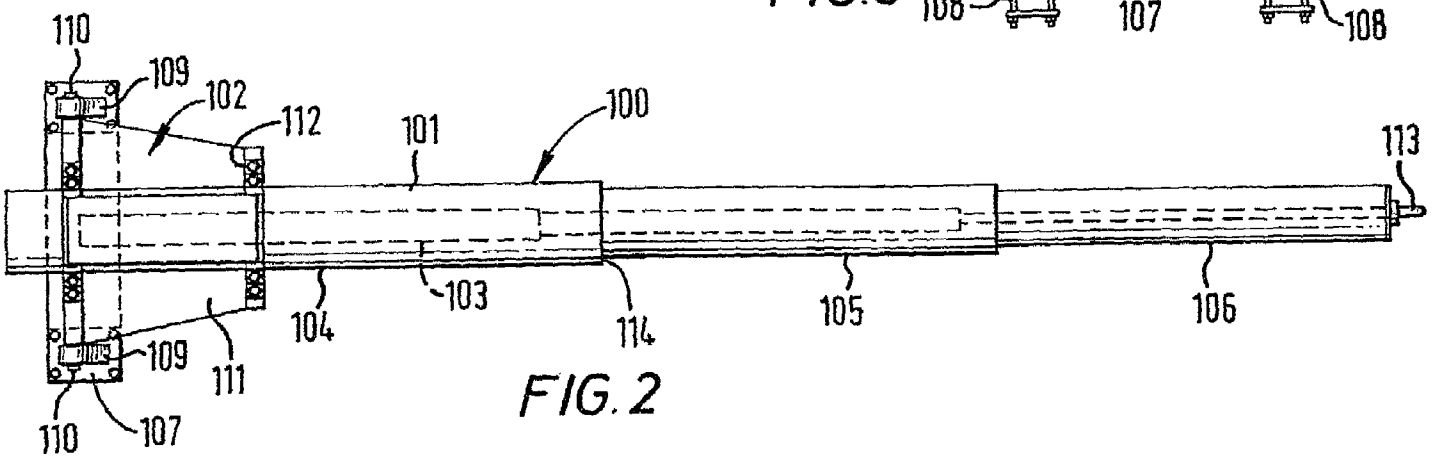
Figure 4:
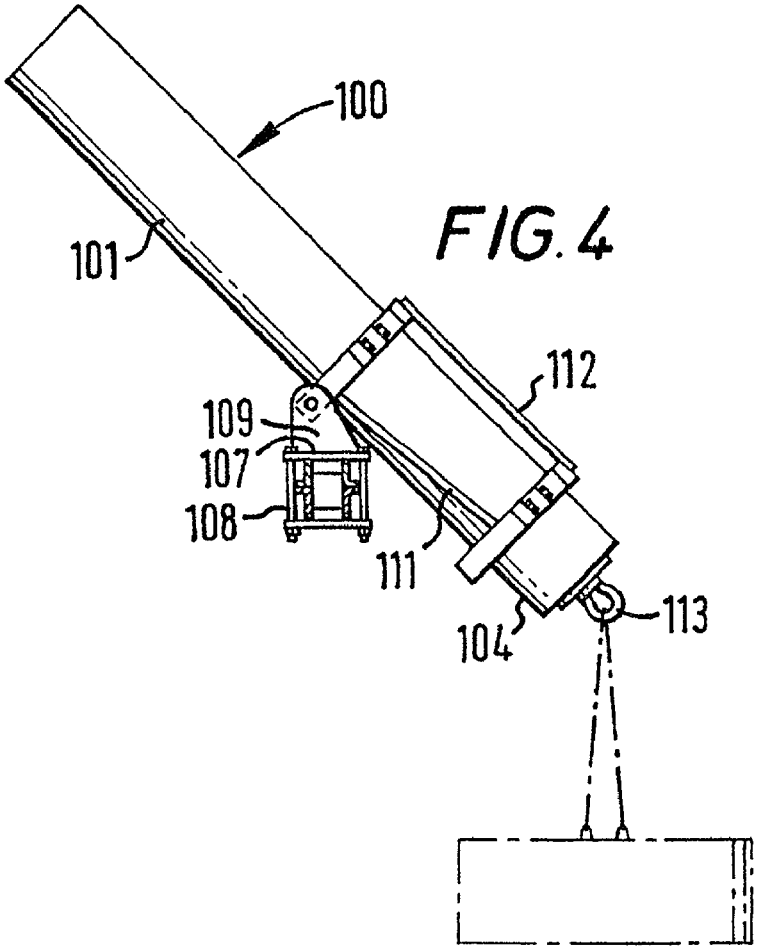
Figure 5:
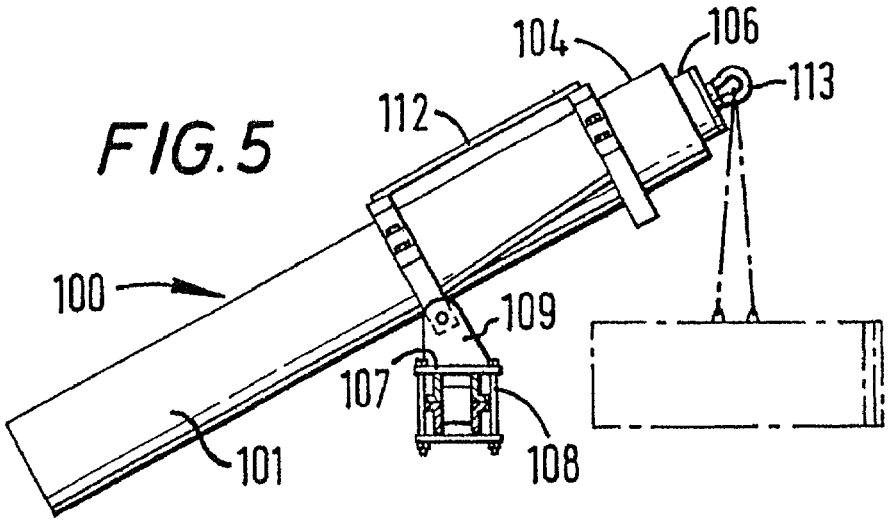

For a better understanding of the present invention reference will now be made, by way of example, to the accompanying drawings, in which:

FIG. 1 is a side elevation of one embodiment of an apparatus in accordance with the present invention in an operative position;

FIG. 2 is a top plane view of the apparatus shown in FIG. 1;

FIG. 3 is an end view taken on line 111—111 of FIG. 1;

FIG. 4 is a perspective view showing the apparatus connected to a tong with the apparatus in a first inoperative position; and FIG. 5 is a perspective view showing the arrangement of FIG. 4 with the apparatus in a second inoperative position.

Figure 6:
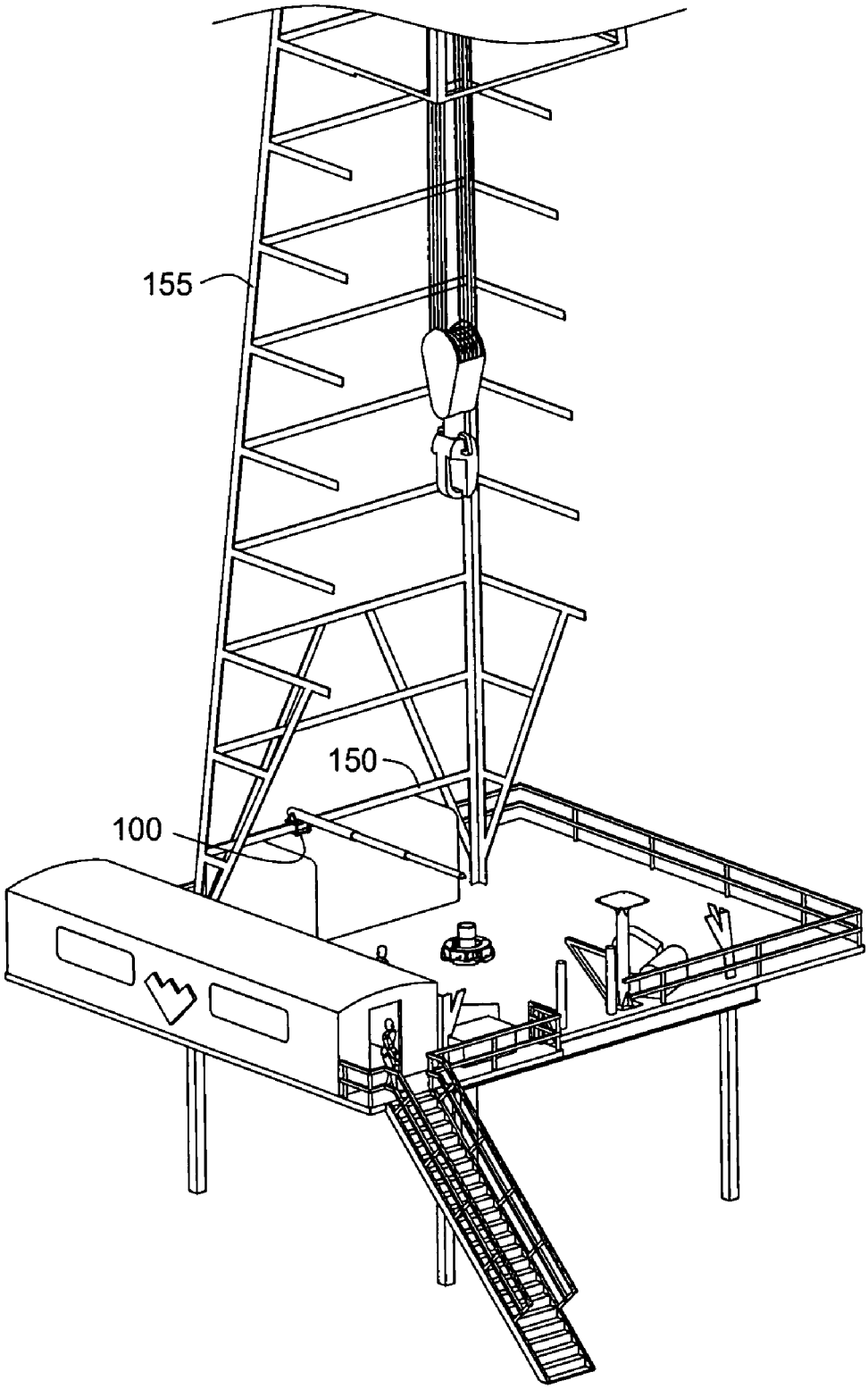

FIG. 6 shows an embodiment of the apparatus disposed on a drilling tower.

DETAILED DESCRIPTION OF THE PREFERRED EMBODIMENT

Referring to FIG. 1 to 3 of the drawings, there is shown an apparatus for positioning a tong. The apparatus, which is generally identified by the reference numeral 100, comprises a piston and cylinder assembly 101 and a mounting assembly 102.

The piston and cylinder assembly 101 comprises a conventional two stage hydraulic piston and cylinder 103 which is mounted internally of a telescopic structure which comprises an outer barrel 104, an intermediate barrel 105, and an inner barrel 106. The inner barrel 106 is slidably mounted in the intermediate barrel 105 which is, in turn, slidably mounted in the outer barrel 104.

The mounting assembly 102 comprises a bearer 107 which can be secured to a beam by two bolt and plate assemblies 108. The bearer 107 includes two ears 109 which accommodate trunnions 110 which project from either side of a carriage 111.

A clamp assembly 112 is bolted to the top of the carriage 111 and maintains the piston and cylinder assembly 101 in position with respect to the mounting assembly 102.

In use, the mounting assembly 102 is first secured to a convenient support beam in the drilling rig by bolt and plate assemblies 108. If necessary, a support beam may be mounted in the drilling rig for this purpose. FIG. 6 shows an embodiment of the apparatus 100 secured to a support beam 150 on the drilling tower 155.

The piston and cylinder assembly 101 is then mounted on the carriage 111 and clamped in position.

A tong is then attached to the free end 113 of the piston and cylinder assembly 101 which is moved with respect to the mounting assembly 102 so that, at full extension, the tong is in the desired position with respect to well centre.

In normal use, the tong can be moved towards and away from well centre by extending and retracting the hydraulic piston and cylinder 103. The outer barrel 104, intermediate barrel 105, and inner barrel 106 extend and contract with the hydraulic piston and cylinder 103 and provide lateral rigidity to the structure. At full extension, the piston and cylinder assembly 101 can be deflected from side to side by a small amount. This movement can readily be accommodated by the two stage hydraulic piston and cylinder 103 although, if desired, the ends thereof could be mounted on, for example, ball and socket joints or resilient mountings.

It will be appreciated that when the piston and cylinder assembly 101 is fully retracted, the free end 113 will lie immediately adjacent the extremity 114 of the outer barrel 104. For many purposes, such retraction would be insufficient and consequently manipulation of tongs by piston and cylinder assemblies has heretofore been deemed untenable. The present invention provides a simple and elegant solution to the problem. In particular, the clamp assembly 112 can simply be slackened, the piston and cylinder 101 slid on the carriage 111 until the extremity 114 lies adjacent the mounting assembly 102 and the clamp assembly 112 re-tightened. When the piston and cylinder assembly 101 is fully contracted, the free end 113 of the piston and cylinder assembly 101 lies closely adjacent the mounting assembly 102 with the tong therebelow. This can clearly be seen in FIG. 4. It will be noted that the piston and cylinder assembly 101 lies on an upwardly extending axis and that a major portion of the piston and cylinder assembly 101 lies to the rear of the mounting assembly 102. It will be noted that, in this position, the tong rests on the workshop floor which simulates the drilling floor.

An alternative inoperative position is shown in FIG. 5. In this position, the tong is suspended from an overhead cable whilst the piston and cylinder assembly 101 again lies along an upwardly extending axis.

For certain operations, it may be desirable to remove the tong completely. In such a case, the apparatus 100 can simply be parked in the inoperative position shown in FIG. 4 or FIG. 5. Preferably, a locking device is provided to ensure that the piston and cylinder assembly 101 remains in its parked position.

The apparatus 100 is preferably made of aluminium and is thus comparatively light and easy to handle.

Various modifications to the apparatus 100 are envisaged. For example, a small hydraulic motor could be provided to move the piston and cylinder assembly 101 with respect to the mounting assembly 102. If desired, means could be provided to enable the outer barrel 104 to be swivelled with respect to the mounting assembly 102 or the mounting assembly 102 itself to be capable of swivelling movement. This would be useful in a situation where the tongs were required, for example, both to make up and break out a pipe string in the well centre and to make up or break out joints in an adjacent location to one side of the well centre. If desired, the piston and cylinder assembly 103 could be pneumatically actuable although this would give this arrangement some "bounce" which might not be desired.

While the foregoing is directed to embodiments of the present invention, other and further embodiments of the invention may be devised without departing from the basic scope thereof, and the scope thereof is determined by the claims that follow.

The invention claimed is:

1. An apparatus for positioning a tong proximate a tubular at a well center, comprising:

an extendable structure, the tong attached to one end of the extendable structure;

an actuating member for extending or retracting the extendable structure relative to the well center, the extendable structure and the actuating member having substantially parallel longitudinal axes; and a mounting assembly coupled to an opposite end of the extendable structure, wherein the mounting assembly includes a bearer and the bearer is coupled to a single location of a support member on a drilling tower.

2. The apparatus of claim 1, wherein the extendable structure is telescopic.

3. The apparatus of claim 2, wherein the extendable structure is pivotable about a vertical axis.

4. The apparatus of claim 2, wherein the extendable structure is pivotable about a horizontal axis.

5. The apparatus of claim 2, wherein the telescopically extendable structure comprises an outer barrel and an inner barrel.

6. The apparatus of claim 5, wherein the telescopically extendable structure further comprises an intermediate barrel.

7. The apparatus of claim 6, wherein at least a portion of the inner barrel is slidably mounted in the intermediate barrel and at least a portion of the intermediate barrel is slidably mounted in the outer barrel.

8. The apparatus of claim 7, wherein a first end of the actuating member is coupled to the outer barrel and a second end is coupled to the inner barrel.

9. The apparatus of claim 5, wherein the mounting assembly further comprises:

a carriage pivotally attached to the bearer, wherein a portion of the outer barrel is disposed on the carriage.

10. The apparatus of claim 9, wherein the tong is movably attached to the inner barrel.

11. The apparatus of claim 10, further comprising a clamp assembly for securing the outer barrel to the carriage.

12. The apparatus of claim 11, wherein the outer barrel is movable between a first position and a second position relative to the carriage.

13. The apparatus of claim 1, wherein the mounting assembly further comprises:

a carriage pivotally attached to the bearer, wherein a portion of the outer barrel is disposed on the carriage.

14. The apparatus of claim 13, further comprising a clamping assembly for securing the extendable structure to the carriage.

15. The apparatus of claim 14, wherein the clamping assembly is releasable connected to the carriage.

16. The apparatus of claim 15, wherein the extendable structure comprises an outer barrel and an inner barrel.

17. The apparatus of claim 16, wherein the extendable structure further comprises an intermediate barrel.

18. The apparatus of claim 17, wherein at least a portion of the inner barrel is slidably mounted in the intermediate barrel and at least a portion of the intermediate barrel is slidably mounted in the outer barrel.

19. The apparatus of claim 15, wherein the extendable structure is pivotable about a vertical axis.

20. The apparatus of claim 15, wherein the extendable structure is pivotable about a horizontal axis.

21. The apparatus of claim 1, further comprising a motor actuable to adjust the position of the extendable structure with respect to said mounting assembly.

22. The apparatus of claim 1, wherein the actuating member comprises a piston and cylinder assembly.

23. The apparatus of claim 22, wherein the piston and cylinder assembly is at least partially disposed on the extendable structure.

24. The apparatus of claim 22, wherein the piston and cylinder assembly is used to move the extendable structure horizontally.

25. The apparatus of claim 1, wherein the tong is movably attached to the extendable structure.

26. The apparatus of claim 1, wherein a center of mass of the tong is substantially aligned with an axis of the extendable structure.

27. The apparatus of claim 1, wherein the mounting assembly is clamped to the support member.

28. The apparatus of claim 1, wherein the mounting assembly is selectively attached to the support member.

29. The apparatus of claim 1, wherein the support member is a beam of the drilling tower.

30. An apparatus for positioning a tong for making up or breaking out tubulars, comprising:

an extendable structure, the extendable structure having a variable length and the tong capable of making up or breaking out tubulars attached to one end of the extendable structure;

a motive assembly having an extendable member for changing the length of the extendable structure; and a mounting assembly for coupling the extendable structure to at most one location on a drilling tower.

31. The apparatus of claim 30, wherein the tong is movably attached.

32. The apparatus of claim 30, wherein the motive assembly comprise a piston and cylinder assembly.

33. The apparatus of claim 30, wherein the extendable structure is movable in at least two planes.

34. The apparatus of claim 30, wherein the extendable structure is slideable along the mounting assembly between a first position and a second position.

35. The apparatus of claim 34, wherein the extendable structure is movable in at least two planes.

36. The apparatus of claim 30, wherein the extendable structure is telescopic.

37. The apparatus of claim 30, wherein a center of mass of the tong is substantially aligned with an axis of the extendable structure.

38. The apparatus of claim 30, wherein the single location is a location on a support beam.

39. The apparatus of claim 38, wherein the extendable structure is clamped to the support beam.

40. The apparatus of claim 39, wherein the extendable structure is clamped using at least one bolt.

41. A method for connecting a first tubular to a second tubular proximate a well center, comprising:

providing an apparatus for connecting the tubulars, the apparatus comprising;

a tong adapted to connect the tubulars;

an extendable structure for positioning the tong;

an extendable actuating member for extending or retracting the extendable structure; and a mounting assembly having a bearer adapted to couple the apparatus to a single location on a drilling tower;

positioning the apparatus on a drilling tower;

actuating the extendable structure to move the tong toward the well center;

engaging the first and second tubulars with the tong; and connecting the first tubular to the second tubular.

42. The method of claim 41, further comprising attaching a support member on the drilling tower.

43. The method of claim 42, wherein the apparatus is coupled to the support member.

44. The method of claim 41, wherein connecting the first tubular to the second tubular comprises rotating the first tubular relative to the second tubular.

45. The method of claim 41, wherein actuating the extendable structure comprises extending the actuating member, thereby extending the extendable structure.

46. An apparatus for positioning a tong for making up or breaking out tubulars, comprising:

an extendable structure, the extendable structure having a variable length and the tong for making up or breaking out tubulars attached to one end of the extendable structure;

a motive assembly for changing the length of the extendable structure, the motive assembly and the extendable structure having substantially parallel axis; and a mounting assembly coupled to an opposite end of the extendable structure, wherein the mounting assembly is adapted to couple the extendable structure to a single location of a support beam disposed above a rig floor.

47. The apparatus of claim 46, wherein the support beam is selectively attached to a drilling tower.

48. The apparatus of claim 46, wherein the mounting assembly is clamped to the support beam.

49. The apparatus of claim 46, wherein the support beam is a convenient beam support.

50. The apparatus of claim 46, wherein the support beam is located between 2 meters and 3 meters above the rig floor.

51. The apparatus of claim 46, wherein the tong is movably attached.

52. The apparatus of claim 46, wherein the motive assembly comprise a piston and cylinder assembly.

* * * * *